US006360676B1

(12) United States Patent
Schepers

(10) Patent No.: US 6,360,676 B1
(45) Date of Patent: Mar. 26, 2002

(54) TRANSPORT ASSEMBLY

(76) Inventor: Klaas Schepers, Struikheide 1, NL-7841 Sleen (NL)

( * ) Notice: Subject to any disclaimer, the term of this patent is extended or adjusted under 35 U.S.C. 154(b) by 0 days.

(21) Appl. No.: 09/600,375

(22) PCT Filed: Jan. 15, 1999

(86) PCT No.: PCT/NL99/00027

§ 371 Date: Aug. 14, 2000

§ 102(e) Date: Aug. 14, 2000

(87) PCT Pub. No.: WO99/36321

PCT Pub. Date: Jul. 22, 1999

(30) Foreign Application Priority Data

Jan. 16, 1998 (NL) ..... 1008057

(51) Int. Cl.[7] ..... B65D 19/38
(52) U.S. Cl. ..... 108/52.1; 108/55.3
(58) Field of Search ..... 108/51.11, 52.1, 108/53.1, 53.2, 55.1, 55.3; 206/595, 596, 598

(56) References Cited

U.S. PATENT DOCUMENTS 2,639,050 A 5/1953 Hoffmann
3,964,623 A * 6/1976 Verhein et al. ..... 108/55.3
5,980,198 A * 11/1999 Coblentz ..... 108/52.1
6,006,675 A * 12/1999 Heil ..... 108/53.3

FOREIGN PATENT DOCUMENTS

| | | |
|---|---|---|
| DE | 2260 751 | 6/1974 |
| EP | 0321099 | 11/1988 |
| EP | 0450 732 | 4/1991 |
| FR | 2446 239 | 1/1979 |
| GB | 1 329 677 | 9/1973 |

* cited by examiner

*Primary Examiner*—Peter M. Cuomo
*Assistant Examiner*—Jerry A Anderson
(74) *Attorney, Agent, or Firm*—Mark Zovko

(57) ABSTRACT

The invention relates to a transporting device (1) comprising a number of carriers (3), a number of pallets (2) therefor and displacing means (16, 17) for displacing the pallets and carriers, wherein each carrier comprises a carrying base (14) and a number of feet arranged thereon and wherein each pallet comprises upward protruding supports (4) which define a support surface for supporting the carrying base of a number of carriers.

15 Claims, 9 Drawing Sheets

TRANSPORT ASSEMBLY

The invention relates to a transporting device with which particularly, but not exclusively, retail trade products in the food sector can be transported on the premises of the manufacturer and the retail trader.

BACKGROUND OF THE INVENTION

It is known to package such products wrapped in cling film in boxes or on boards and to place them on pallets, whereafter they can be placed in a truck using a fork-lift truck. At the premises of the retail trader the pallets are again removed from the truck with fork-lift trucks. The packaged articles can then be removed from the packaging and placed in racks on the retail premises so that customers can take them from the racks when they make their purchases.

The articles packed on boards are often also placed in packed state in the store, whereafter the customers take the articles out of the packaging or take away whole packages at a time.

SUMMARY OF THE INVENTION

The invention has for its object to have the transport from the manufacturer to the final customer take place more efficiently and therefore with cost-saving.

This objective is achieved with the transporting device as characterized in claim 1. On the premises of the manufacturer the articles can be placed on the carriers so that a quantity of articles can be displaced simply using the carrier. A number of carriers with the articles in question can be placed on a pallet and be transported as a whole to a truck with a fork-lift truck in a manner usual for pallets and be unloaded again at the place of destination. The carriers can then be set down directly in the store, separately or in small numbers, without further transfer of the articles being necessary. Due to the upward protruding supports of each pallet the carrying base of the carriers, and therefore the whole carrier with the articles thereon, is well supported so that the assembly of pallet, carriers and packed articles forms a stable, easily transportable whole.

The measure of claim 2 is preferably applied. It is hereby possible to also displace the separate carriers using a fork-lift truck. The fork-lift truck can for instance simultaneously remove a number of the carriers from the pallet and set these down again at a suitable location.

In accordance with a very advantageous further development of the invention, the measure of claim 3 is applied. The displacing means can engage vertically through the recess of the pallet onto the carriers, and in particular the carrying bases thereof, in order to raise them clear of the pallet for further transport, e.g. to a conveyor belt or into transport rails in a truck.

When the measure of claim 4 is applied the carriers can be lifted up under the feet and then for instance pushed off the pallet on their own feet. When the feet are formed by wheels, the carriers can be rolled off in favourable manner.

When according to a preferred embodiment the supports are provided with centring edges adjacently of the supporting surface, the position of the carriers relative to the pallet can be determined easily during placing of the carriers, which enhances rapid operation with the transporting device according to the invention. In addition, the centring edges prevent the carriers shifting over the supports during transport.

Applying the measure of claim 6 herein achieves that the carriers find more or less automatically the correct position on the pallet when they are lowered thereon. A good positioning is also enhanced with the measure of claim 7. The feet of the carriers can slide along the sloping side surfaces and contribute toward positioning of the carrier, while when the feet of the carrier are swivel casters these are moreover rotated into a predetermined position.

A good stackability of the pallets can herein be achieved with the measure according to claim 7.

A suitable further development is characterized in claim 8. In this case the parts of the displacing means are for instance blocks which, at the position of the feet of the carriers disposed on the pallet, are arranged in the pallet for limited displacement By pressing these pallets upward from below the carriers are lifted up under their feet and can subsequently be pushed on their own feet off the pallet over the blocks and the adjacent parts of the pallet or, if the feet are wheels, they can be rolled off the pallet.

The measure of claim 10 is preferably applied. This ensures that the carriers cannot move off the pallet, for instance during transport over rough terrain.

Applying the measure of claim 11 achieves that the cargo covers the whole surface defined by the pallet, so that when a number of pallets are placed mutually adjacently a minimum space is occupied, this being particularly important in the case of transport by truck.

When the base of the carrier is provided with a closed strip extending between the feet, the displacing means can engage on this strip and thereby displace the carrier. in this case the displacing means can for instance comprise a conveyor belt which engages under the carrier and displaces it in self-propelled manner on its feet in the form of wheels. Displacing means optionally engaging through recesses in the pallet also find a suitable grip on this closed strip.

Where it is the intention to dispose a pallet with carriers and load placed thereon as a whole in a retail area, the measure of claim 13 is preferably applied. The concealing strips hide the pallet and the carriers from view so that an attractive, evenly finished appearance of the whole is achieved. The concealing strips can be provided in appropriate manner with printed advertising, for instance relating to the products carried by the carriers.

According to a further development of the transporting device according to the invention the measure of claim 14 is applied. The pallet can acquire a determined shape and/or size as required, thus enabling a very efficient use of available space and means.

DETAILED DESCRIPTION OF THE INVENTION

Figure 1:
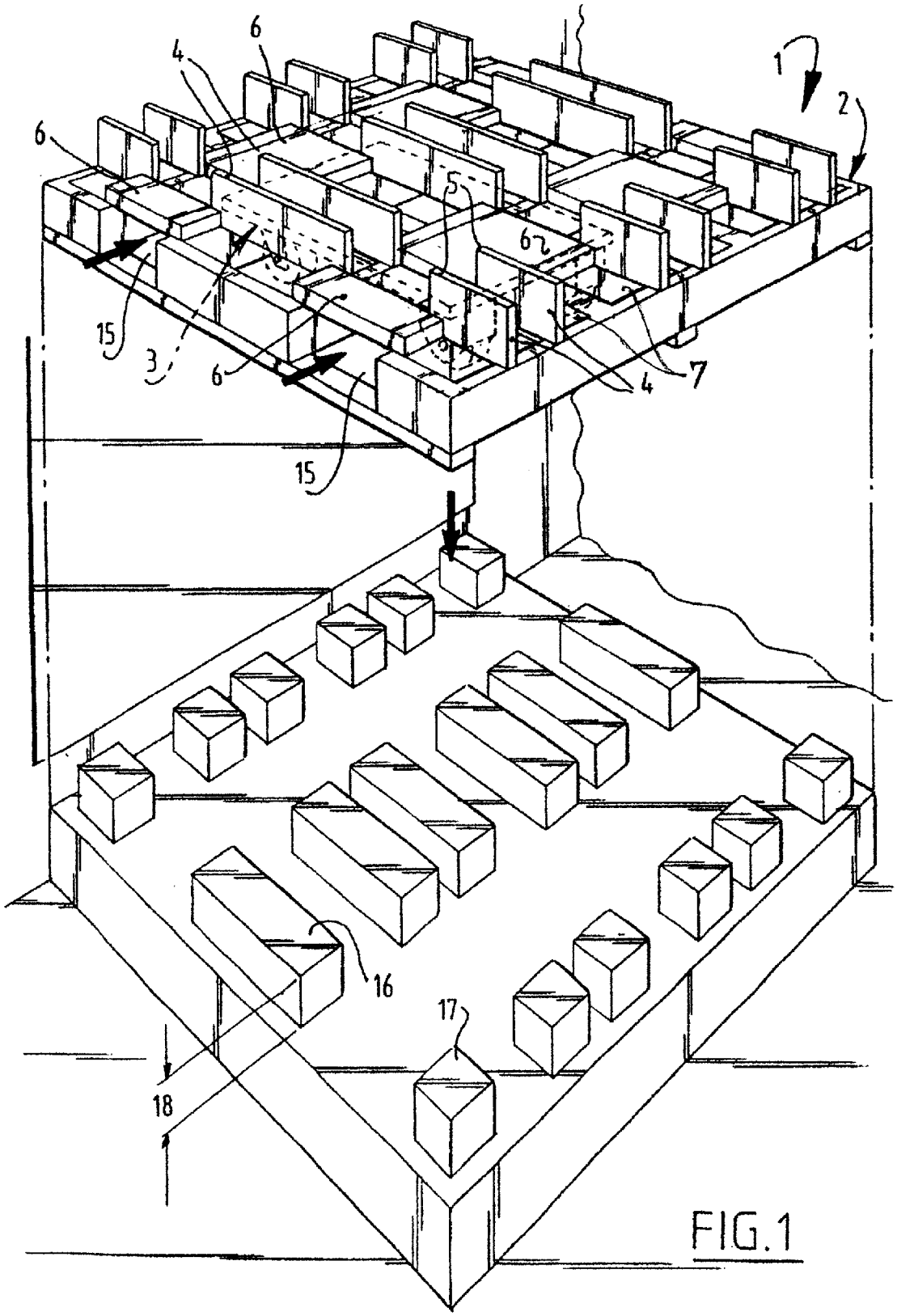
FIG. 1 shows in partly schematic perspective view a pallet, roller carrier and displacing means of a transporting device according to the invention.

The transporting device 1 shown in FIG. 1 comprises a number of pallets 2 onto which can be placed roller carriers 3 as indicated with dashed lines. The device further comprises displacing means for displacing the pallets and roller carriers A roller carrier according to a preferred embodiment of the invention is shown in detail in FIG. 9. It can be seen that this roller carrier 10 comprises a carrying base 14 which is provided on its underside close to its corners with four feet in the form of two rigid casters 11 and two swivel casters 12. Articles for transporting can be placed on carrying base 14 of roller carrier 10.

Figure 9:
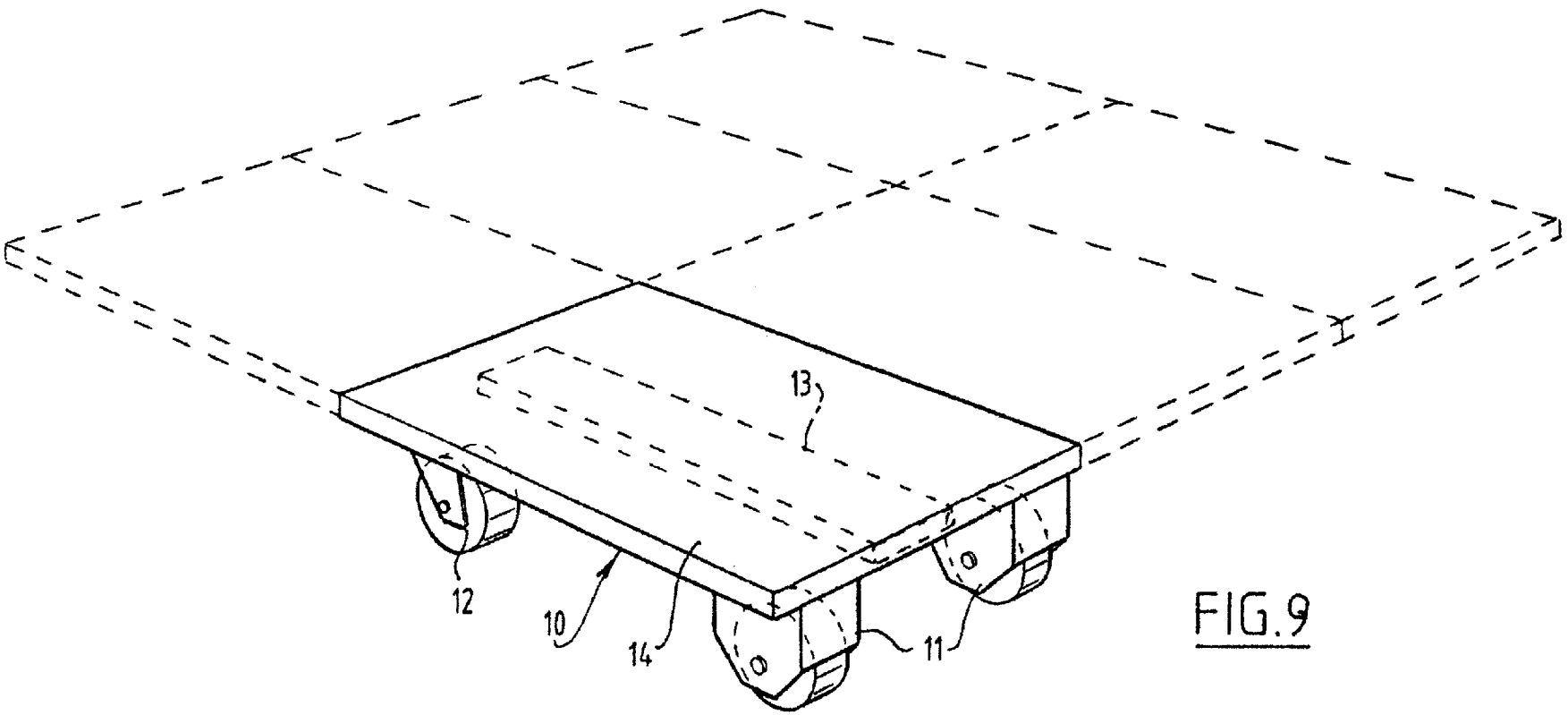
FIG. 9 shows a roller carrier of the transporting device according to the invention.

As indicated with dashed lines in FIG. 9, six roller carriers 10 placed together have the same basic shape as that of a pallet. In other words, precisely six roller carriers 10 can be accommodated on a pallet such as pallet 2 in FIG. 1.

For arranging of roller carriers 10 on a pallet such as pallet 2, this latter is provided with a number of upward protruding supports 4 which define a support surface 5 for supporting the carrying base 14 of roller carriers 10.

Pallet 2 is provided in per se usual manner with a number of insertion openings 15 into which the forks of a fork-lift truck can protrude in order to pick up and displace the pallet 2 with the roller carriers 10 placed thereon.

As shown in FIG. 1, pallet 2 is embodied such that wheels 11, 12 of the roller carriers are situated above and partly in recesses 7 which are intended for vertical passage of parts of the displacing means. These displacing means are shown somewhat schematically in FIG. 1 by the block-shaped lifting members 16, 17 which can be lifted up and downward through a lift height 18.

Figure 2:
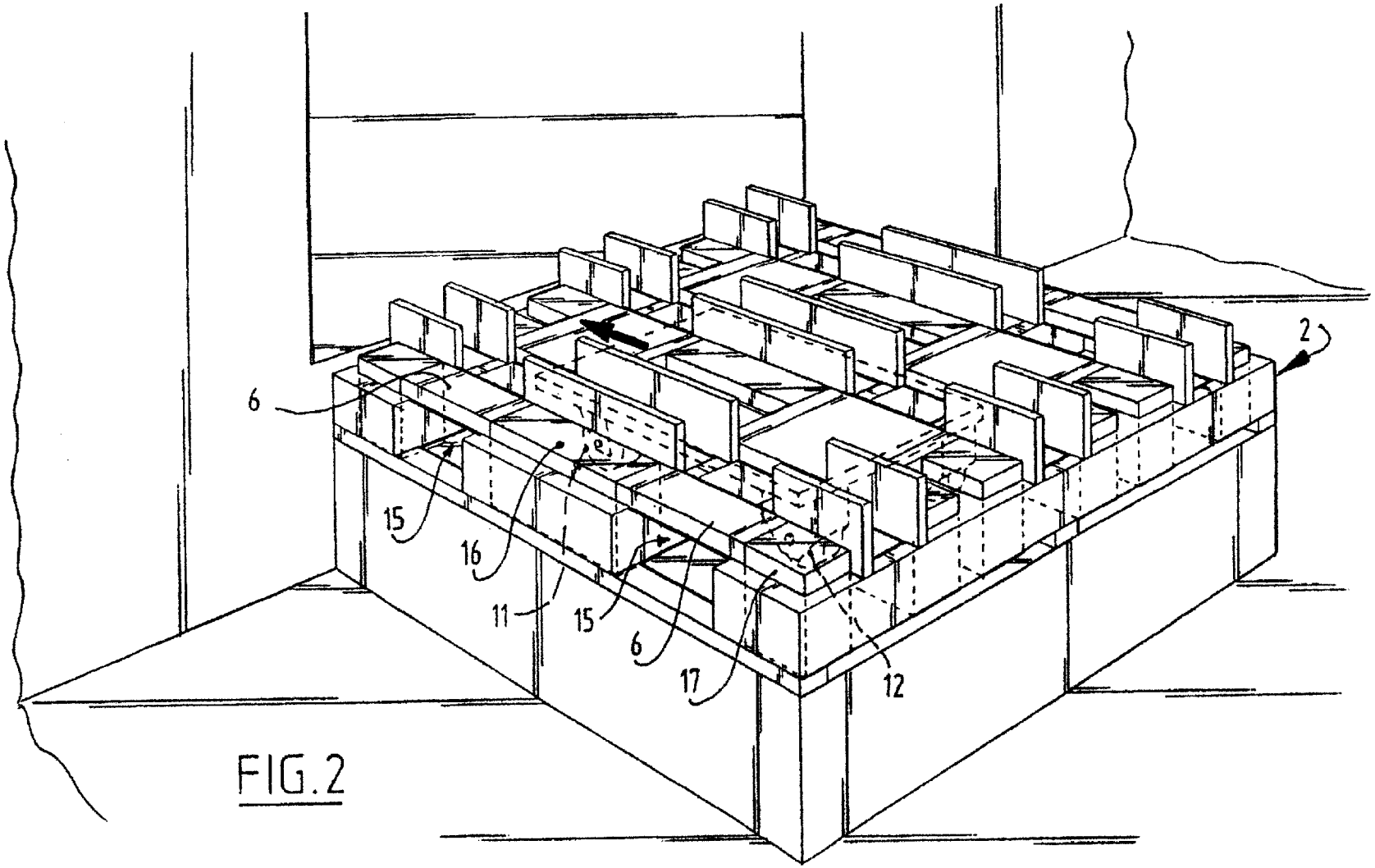
FIG. 2 shows the components of FIG. 1 in assembled state.

FIG. 2 shows the situation in which pallet 2 has been lowered onto the displacing means and lifting members 16, 17 have been moved upward into recesses 7. In the moved upward situation the upper surface of lifting members 16, 17 lies in the same plane as the upper surface of connecting blocks 6 of pallet 2. When lifting members 16, 17 are moved upward the roller carriers are thus lifted up under their wheels 11, 12, whereafter they can be moved off or onto the pallet over the continuous paths formed by lifting members 16, 17 and connecting blocks 6.

FIG. 1 clearly shows the recesses in pallet 2 which correspond with lifting members 1s, 17 and through which parts of the displacing means can move vertically upward. These displacing means do not have to be more or less stationary blocks 16, 17 but may also be conveyor belts or wheels with which the roller carriers can be moved in driven manner.

The use of the transporting device according to the invention has advantages for both the producer and the retail trader. At the manufacturing site the roller carriers can be loaded in simple manner with the products at the location where these products for transporting are manufactured. These products can then be displaced on the roller carriers to the device where these loaded roller carriers are positioned on pallet 2. As noted, this can take place by moving the roller carriers onto pallet 2 in the situation shown in FIG. 2 or using other transporting means such as conveyor belts and the like.

It is also possible to place the roller carriers onto pallet 2 using a fork-lift truck. Above insertion openings 15 in pallet 2 free spaces are situated in each case between the supports such that lift forks can also be inserted therein. These lift forks, engaging under carrying base 14 of rollers carrier 10, can thus place these latter onto or remove them from pallet 2.

Figure 3:
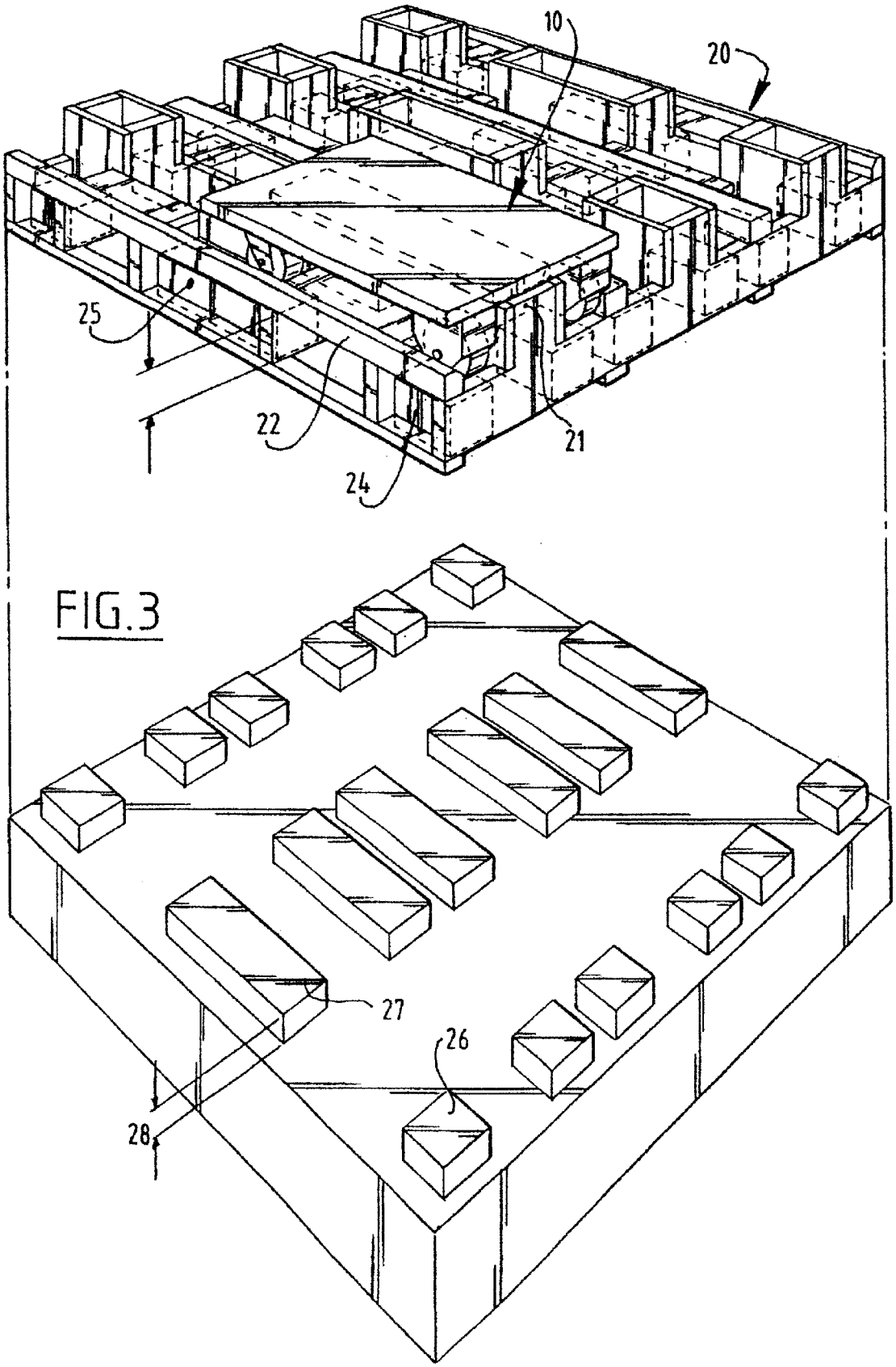
FIG. 3 shows a view corresponding with FIG. 1 of another embodiment.

At the retail premises the loaded roller carriers can be taken off pallet 2 in simple manner and displaced to the stockroom or preferably the retail display rack into which they can be directly positioned. The roller carriers can optionally be provided with a superstructure in which the goods can be arranged such that they are easily accessible for the final customers, FIG. 3 shows a somewhat different pallet 20 which is also provided with supports 21 for supporting the carrying base of roller carriers 10. The pallet is herein provided with enclosing means 22, 23 in the form of upright edges which co-act or, the sides with wheels 11, 12 of the roller carrier in order to prevent a lateral displacement of the roller carriers relative to pallet 20.

Parts of the displacing means are further arranged in pallet 20. These parts are formed in particular by slide blocks 24, 25 which are enclosed for limited vertical displacement. In the situation where pallet 20 is free of the displacing means the slide blocks 24, 25 will occupy a lower position whereby they are not in supporting contact with the wheels of the roller carriers.

When pallet 20 is positioned an the displacing means in accordance with the method shown in FIG. 2, slide blocks 24 can be pressed upward using lifting members 26, 27, which only have to be movable upward through the limited distance 28, in order to raise the carrying base of roller carrier 10 clear of supports 21. The roller carriers can then be moved off the pallet in the manner described above. Loading will of course take place in reverse manner.

Figure 4:
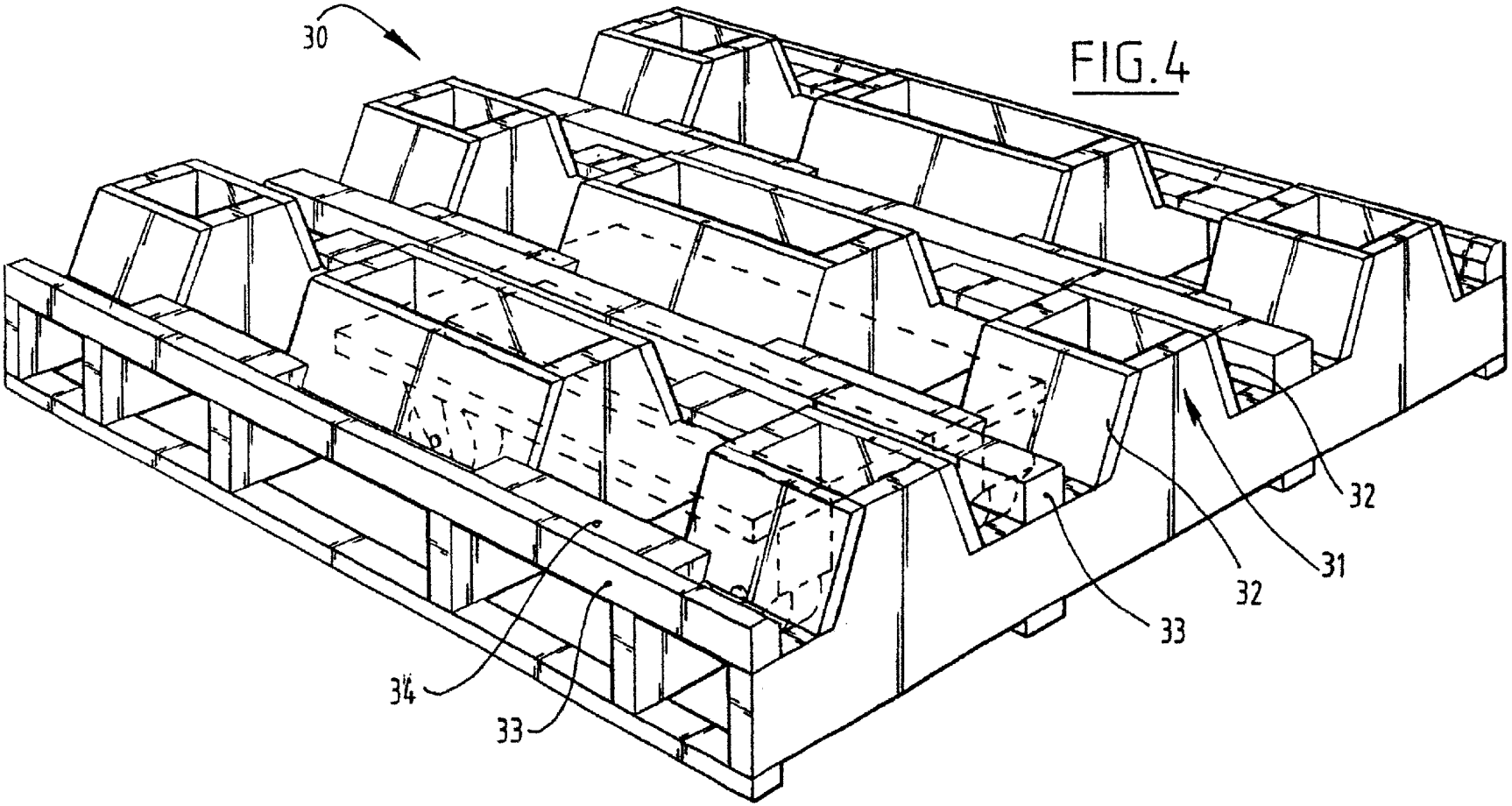
FIG. 4 shows a pallet according to a further developed embodiment of the invention.
Figure 5:
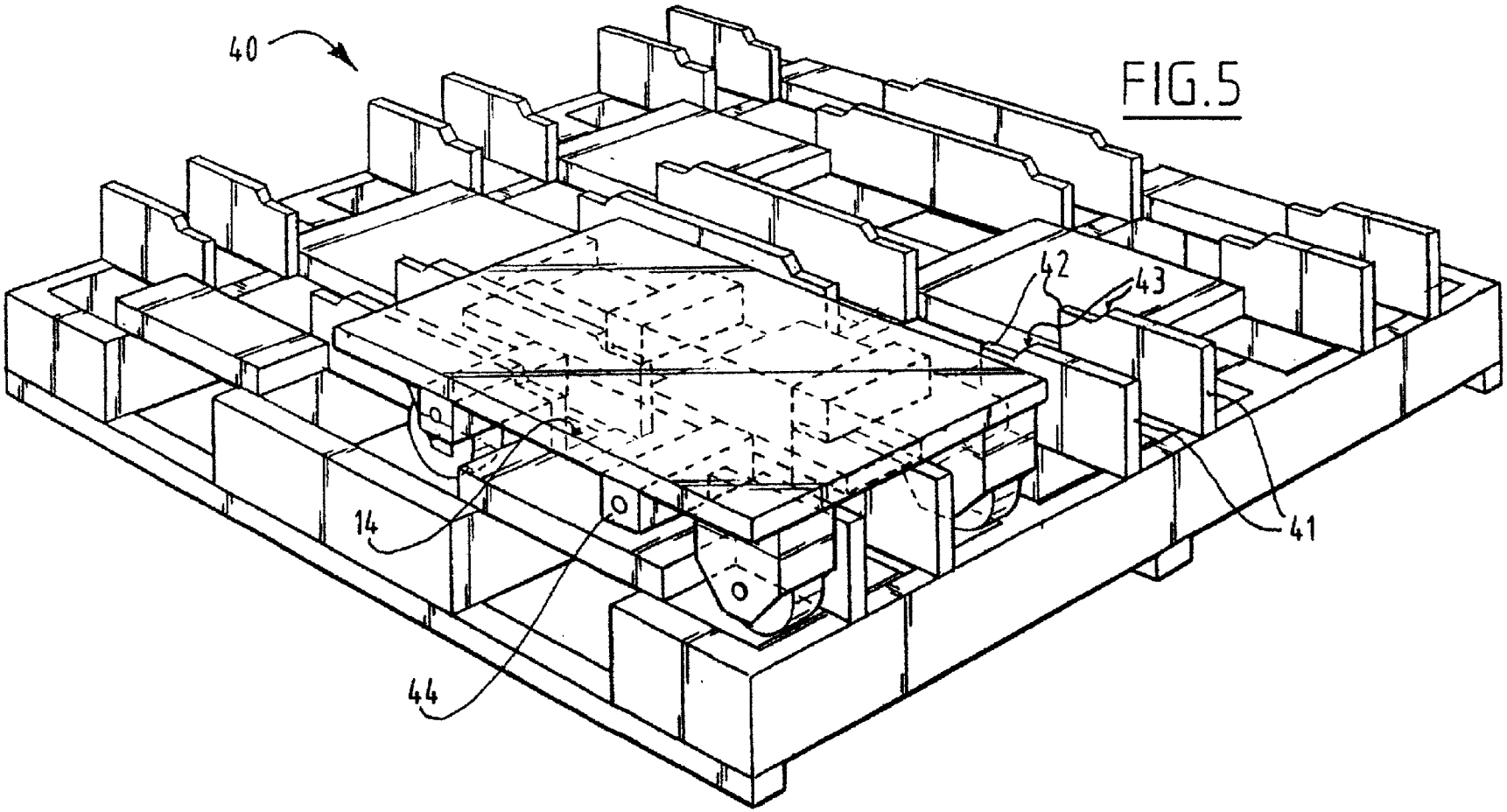
FIG. 5 shows yet another embodiment of a pallet according to the invention.

Pallet 30 of FIG. 4 for a transporting device according to the invention is distinguished in that supports 31 are provided with sloping side surfaces 32. These are particularly useful when the roller carriers are placed onto pallet 30 from above using for instance a fork-lift truck. Due to the centring action of the sloping side surfaces, the roller carriers come to lie automatically in the correct position on pallet 30 when they are set down.

Further arranged on pallet 30 are enclosing means 33 in the form of upright edges for enclosing the roller carriers at the sides and there are furthermore blocks 34 in front of and behind which wheels 11, 12 of the roller carrier position themselves so that reciprocal shifting of the roller carriers is also avoided.

In the shown embodiment of pallet 30 only two mutually opposite side surfaces of supports 31 take a sloping form. When the other two side surfaces are also placed obliquely, a number of pallets 30 in this embodiment can be stacked in space-saving manner. The supports then protrude into the spaces enclosed by the walls of the supports 31 of the pallet thereabove.

In pallet 40 the supports 41 are provided with parts 42 recessed at a lower level. These co-act with the bottom surface of mounting tubes 44 which are arranged against the underside of carrying base 14 of roller carrier 10. The recessed portions 42 transpose via inclining surfaces 43 into the upper surface of supports 41. Due to these inclining surfaces 43 the roller carrier, when it is placed on pallet 40 with for instance a fork--lift truck, will come to lie automatically centred at its correct position.

Mounting tubes 44 are intended for mounting of concealing strips which can extend over the whole height from the underside of pallet 40 as far as the top of carrying base 14. Due to these concealing strips; which are not shown in the figures, pallet 40 and the roller carrier can be hidden from view, so that an attractive, evenly finished appearance is obtained, this being advantageous when a pallet with roller carriers is disposed directly in a space accessible to the buying public. The concealing strips can optionally be provided with a suitable printing, for instance with advertising.

Instead of concealing strips extending over the whole height of a roller carrier and a pallet, less high concealing strips can of course also be used which cover only the roller carrier in the case the products for sale are placed only on a roller carrier in a space accessible to the public. Mounting tubes 44 can be provided for instance in their end surfaces with a screw thread in which can be received a mounting screw. Another option is to mount the concealing strips with for instance clamps or velcro tape.

Figure 6:
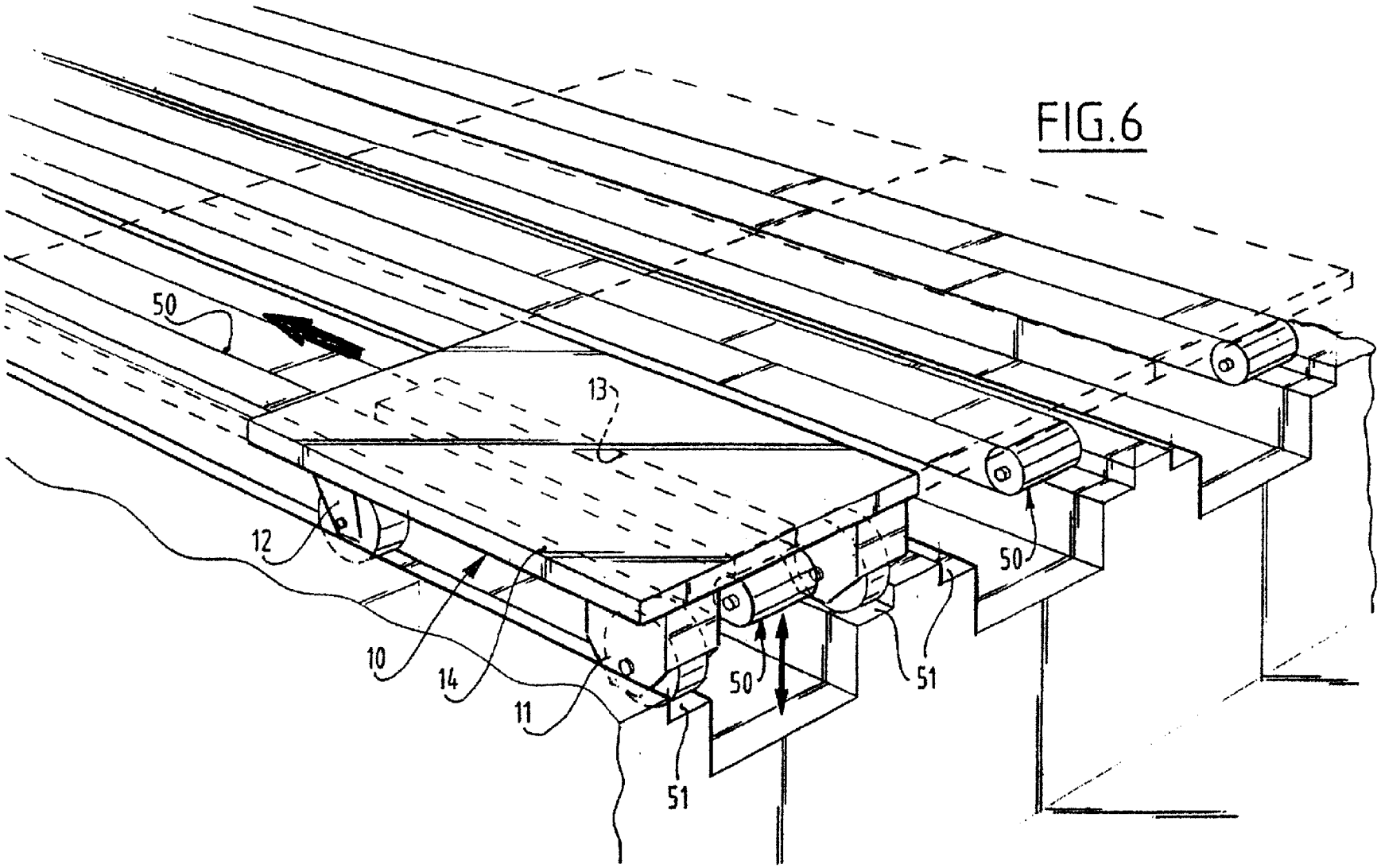
FIG. 6 shows other components of the transporting device according to the invention.

FIG. 6 shows other parts of the displacing means of a transporting device according to the invention. These parts can for instance comprise guide tracks 51 in a floor surface. This floor surface can be the floor of a storage area or the loading floor of a truck or the like, or a table in. a logistical transport system provided with guide tracks for positioning of the rolling modules.

The displacing means further comprise conveyor belts 50 which extend in the longitudinal direction of guide track 51 and which engage with their top part onto the underside of carrying base 14 of roller carriers 10. Particularly in this respect the roller carriers 10 are provided on the bottom surface of the carrying base with a closed strip 13 which extends between wheels 11, 12 and ensures a good contact with conveyor belt 50. The carrying base car herein be of any appropriate construction, such as a closed plate-like construction as shown in the figures, or have a grid or mesh-like construction.

Roller carriers 10 can be displaced over the floor using conveyor belts 50. Conveyor belts 50 can optionally be extensible and engage directly round roller carriers 10 present on a pallet disposed on the floor. The roller carriers can then be moved off the pallet onto the loading floor.

Conveyor belts 50 can be embodied for vertical movement in order to place them out of contact with the roller carriers. The roller carriers can then be displaced by manual operation over the loading floor. When the loading floor is the floor of a truck, conveyor belts 50 can also be held in contact with roller carriers 10 in order to anchor their position.

Figure 7:
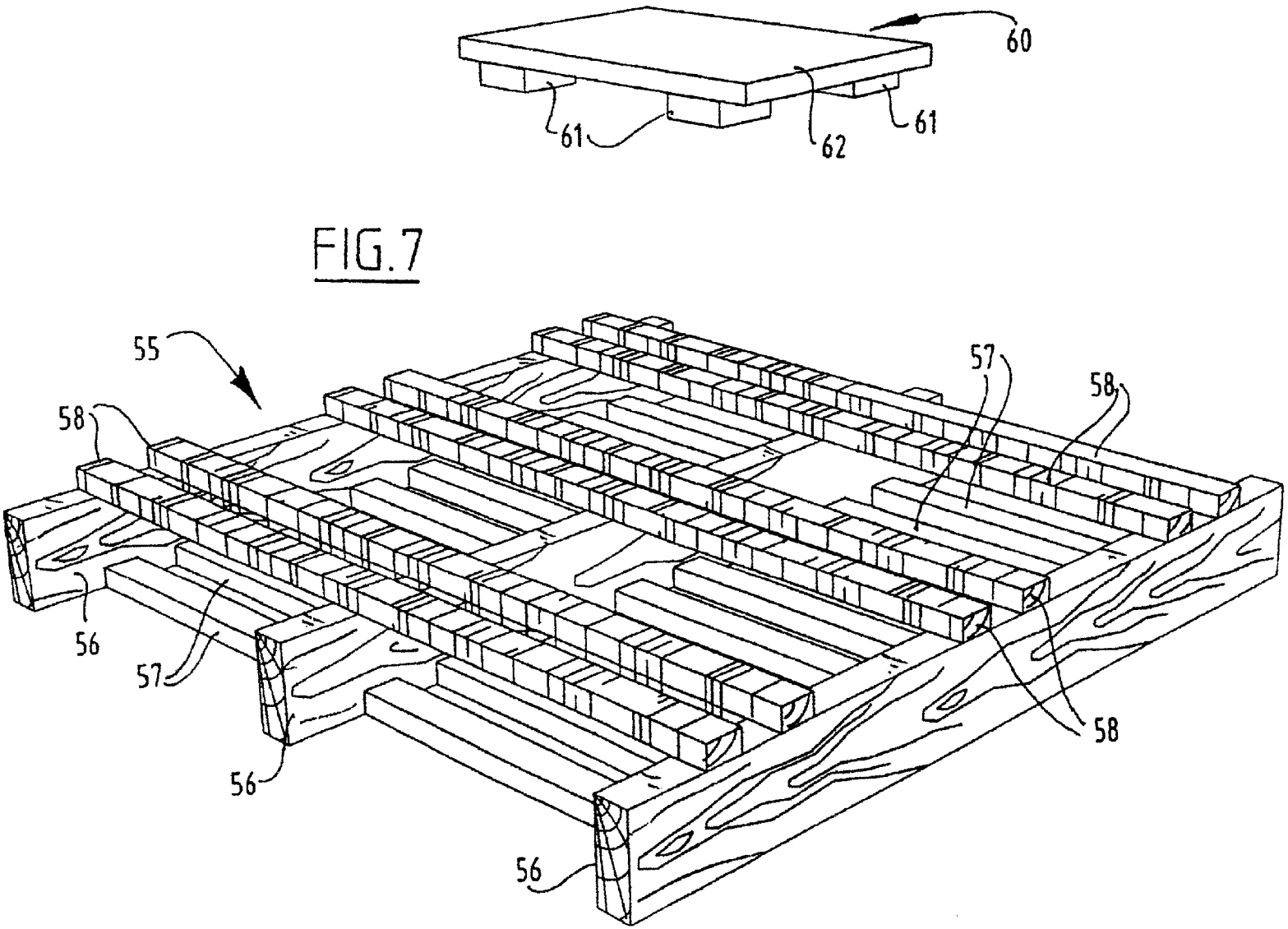
FIG. 7 shows a pallet and a carrier according to another embodiment.

Pallet 55 shown in FIG. 7 is formed in principle by three beams 56 on which three pairs of slats 58 are arranged, for instance by nailing or screwing. Three pairs of slats 57 are likewise arranged on the underside in recesses in beams 56 arranged for this purpose. Carriers 60, which in this embodiment comprise a carrying base 62 with four feet 61 close to the corners, can be disposed on pallet 55. Slats 58 herein form the upward protruding supports, the upper surfaces of which can support the carrying bases 62 of a number of carriers 60.

Openings for vertical passage of parts of the displacing means are formed between adjacent slat pairs 57 respectively 58. A space is formed between slat pairs 57 and 58 into which can be inserted the forks of a fork-lift truck.

Instead of carriers 60 with immobile feet 61, roller carriers can of course also be deployed on pallet 55.

The advantage of the embodiment of FIG. 7 is that it has of itself a small height so that it takes up little space.

Slat pairs 58 can also be arranged flush with beams 56 as are slat pairs 57. In this case feet 61 can be placed in appropriate manner such that they lie on one side against the two successive beams 56 and on the other side against the slats of the relevant slat pair 58. Carrier 60 is thus supported on the pallet in well fixed manner.

Figure 8:
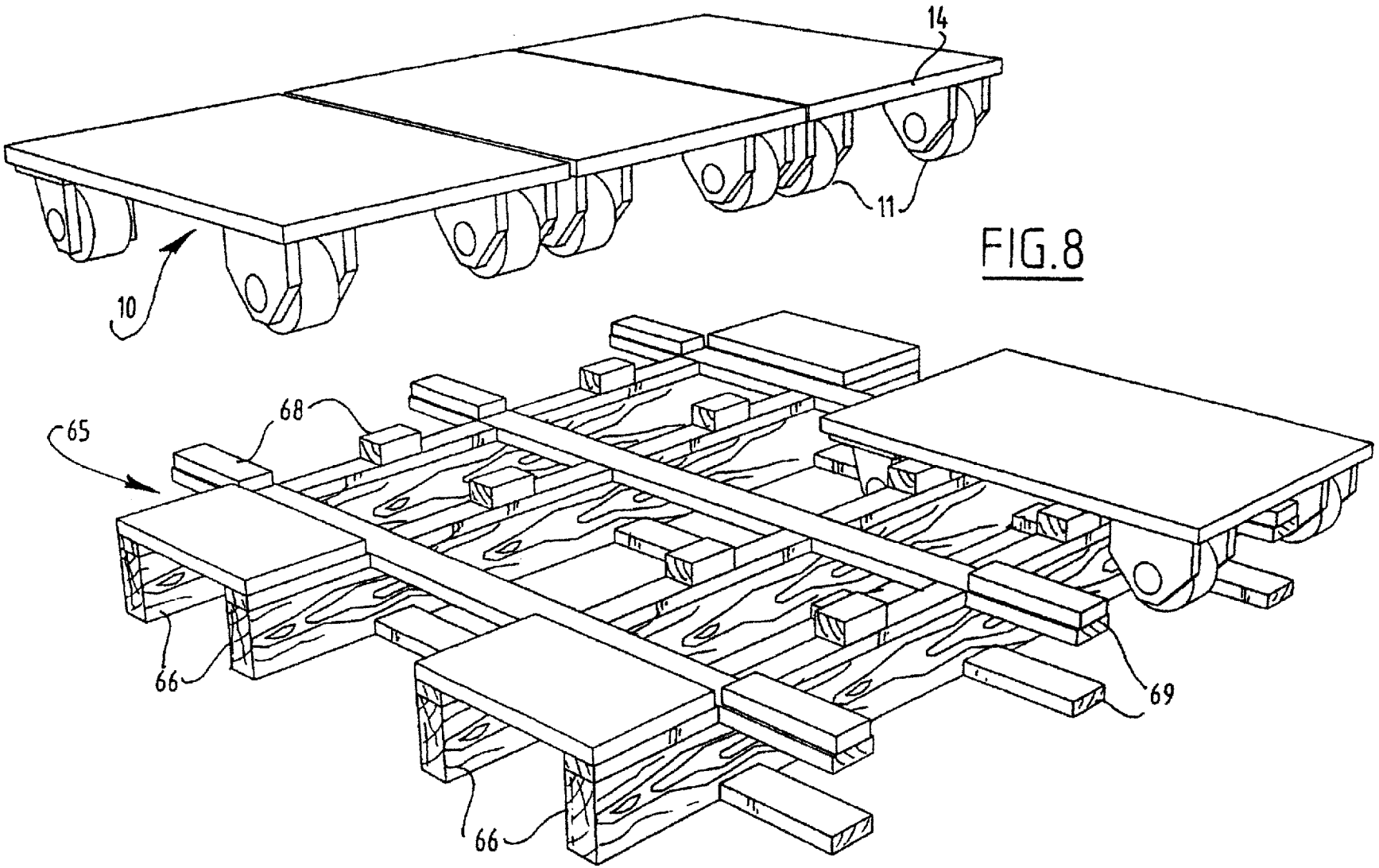
FIG. 8 shows yet another embodiment of a pallet and roller carrier.

Pallet 65 of FIG. 8 does not have the square or rectangular peripheral form of a typical pallet. Only the parts required for engaging the forks of a fork-lift truck and for fixing the supports for supporting the carrying bases 14 of carriers 10 are arranged in this pallet 65.

The basic construction of pallet 65 consists of four beams 66 mutually connected with slats 69. Fastened onto slats 69 and beams 66 are connecting/support plates 67 and blocks 68 which are of course arranged such that the carrying bases of carriers 10 are supported in appropriate manner.

As described above, FIG. 7 shows that a number of roller carriers together have the surface area of one pallet. The pallets can however also be embodied in a manner which is further self-evident such that they can be assembled from a number of connectable separate pallet parts. Each pallet part then has the same surface area as one or several of the roller carriers.

The invention is not limited to the embodiments described here. The roller carriers can for instance have a size other than that corresponding to ⅙ of a pallet. The construction of the pallet itself can also vary greatly, depending particularly on the material applied. It is thus possible to construct the pallets for the transporting device according to the invention in more or less usual manner from wooden components, but it is of course also possible to manufacture them from sheet-metal or injection mould them from plastic.

The displacing means co-acting with the pallets and roller carriers can likewise be embodied in many different ways.

All these variations fall within the appended claims.

What is claimed is:

1. Transporting device comprising a number of carriers, a number of pallets therefor and displacing means for displacing the pallets and carriers, wherein each carrier comprises a carrying base and a number of feet arranged thereon and wherein each pallet comprises upward protruding supports which define a support surface for supporting the carrying base of a number of carriers.

2. Transporting device as claimed in claim 1, wherein space is free in lateral direction between the supports for the insertion of lift forks.

3. Transporting device as claimed in claim 1, wherein the pallet is provide with recesses for vertical passage of parts of the displacing means.

4. Transporting device as claimed in claim 3, wherein the recesses are positioned at least under the feet of the carriers disposed on the pallet.

5. Transporting device as claimed in claim 1, wherein the supports are provided with centering edges adjacently of the support surface.

6. Transporting device as claimed in claim 5, wherein the centring edges extend obliquely upward from the support surface.

7. Transporting device as claimed in claim 1, wherein the supports have inclining side surfaces.

8. Transporting device as claimed in claim 1, wherein parts of the displacing means are accommodated displaceably in the pallet.

9. Transporting device as claimed in claim 8, wherein the displaceable parts of the displacing means comprise elements enclosed for limited vertical displacement.

10. Transporting device as claimed in claim 1, wherein the pallet is provided with enclosing means which can co-act on the sides with feet of the carriers.

11. Transporting device as claimed in claim 1, wherein the basic shape of the pallet is the same as that of a number of carriers placed against each other.

12. Transporting device as claimed in claim 1, wherein the base of the carrier is provided with a closed strip extending between the feet.

13. Transporting device as claimed in claim 1, comprising concealing strips arranged on edges of the pallet to the height of the pallet and carriers placed thereon.

14. Transporting device as claimed in claim 1, wherein the pallet is assembled from a number of connectable separate pallet parts.

15. Transporting device as claimed in claim 1, wherein the feet are wheels.

* * * * *